United States Patent [19]

Payne et al.

[11] Patent Number: 4,694,167

[45] Date of Patent: Sep. 15, 1987

[54] DOUBLE PULSED TIME-OF-FLIGHT MASS SPECTROMETER

[75] Inventors: Marvin G. Payne; Norbert Thonnard, both of Anderson County; George S. Hurst, Roane County, all of Tenn.

[73] Assignee: Atom Sciences, Inc., Oak Ridge, Tenn.

[21] Appl. No.: 802,841

[22] Filed: Nov. 27, 1985

[51] Int. Cl.[4] ..... H01J 49/40

[52] U.S. Cl. ..... 250/282; 250/287

[58] Field of Search ..... 250/281, 282, 286, 287, 250/288, 423 P, 492.21

[56] References Cited

U.S. PATENT DOCUMENTS

| | | | |
|---|---|---|---|
| 3,660,655 | 5/1972 | Wardell | 250/282 |
| 4,039,828 | 8/1977 | Pokar et al. | 250/288 |
| 4,426,576 | 1/1984 | Hurst et al. | 250/288 |
| 4,442,354 | 4/1984 | Hurst et al. | 250/281 |
| 4,458,149 | 7/1984 | Muga | 250/287 |

OTHER PUBLICATIONS

Wiley et al., "Time of Flight Mass Spectrometer with Improved Resolution," Rev. Sci. Int., vol. 26, p. 1150 (1955).

Mamyrin et al., "The Mass-Reflection, a New Non--Magnetic Time-of-Flight Mass Spectrometer with High Resolution," Soviet Physics JEPT, vol. 37, (1973).

Lubman et al., "Design for Improved Resolution in a Time-of-Flight Mass Spectrometer Using a Supersonic Beam and a Laser Ionization Source," Rev. Sci. Inst., vol. 56, p. 375 (1985).

Opral et al., "Resolution in the Linear Time-of-Flight Mass Spectrometer," Anal. Chem., vol. 57, p. 1884 (1985).

Thonnard et al., Inst. Phys. Conf., Ser. No. 71,227 (1984), "Noble Gas Atom Counting Using RIS and TOF Mass Spectrometry."

*Primary Examiner*—Carolyn E. Fields
*Assistant Examiner*—Paul A. Guss
*Attorney, Agent, or Firm*—Pitts and Brittian

[57] ABSTRACT

An improved method of operating a time-of-flight mass spectrometer. This method, which involves double pulsing, achieves an increase in the resolution of TOF mass spectrometers by compensating for the energy spread of the species extracted from the source and thus the time spread of ions of a specific mass arriving at a detector. According to this improved method, atoms (or molecules) for analysis are rapidly removed from a surface at a first well defined time. These atoms or molecules are then rapidly ionized at a location or region a distance, R, from the surface at a second well defined time after a selected time delay, $T_o$. The resultant ions first move through a region of uniform electric field of a distance, $S_1$, and then into a field-free region having a length, $S_2$, Lastly, ions leaving the field-free region enter a short high energy accelerating region so as to impinge upon an ion detector. The output signal of the detector, as a function of arrival time, is an indication of the mass distribution of the ions and thus the analysis of the atoms or molecules. A proper choice of the uniform electric field and parameters R, $S_1$, $S_2$, and $T_o$ provide compensation for the energy spread of ionized species and thus a reduction in time spread of ions at the detector. Certain special cases for enhanced resolution are described, as well as operation of the TOF according to the improved method to achieve atom enrichment of a specific mass.

22 Claims, 3 Drawing Figures

DOUBLE PULSED TIME-OF-FLIGHT MASS SPECTROMETER

TECHNICAL FIELD

This invention relates to an analytical method and apparatus for simultaneously determining the abundance of the different mass fractions of a substance. More particularly, the invention is an improvement in method and apparatus for the analytical technique commonly known as time-of-flight mass spectrometry which allows considerably improved discrimination between adjacent masses in spite of a large kinetic energy distribution of the material being analyzed.

BACKGROUND ART

Over the years, mass spectrometry has been the analytical method of choice used in accurate and sensitive determination of the atomic or molecular composition of a sample. Time-of-flight (TOF) mass spectrometers have been one type of apparatus used for mass spectrometry. In recent years, the applications and uses for the time-of-flight mass spectrometer have increased considerably as compared to other methods. The salient characteristics of this type of mass spectrometer are its high sensitivity due to the near unity transmission of the ions through the system and the near simultaneous detection of all masses thereby utilizing all created ions. A drawback for these instruments has been the relatively poor resolution or mass discrimination due to the energy spread (which leads to time smearing) of species extracted from the ion source region. The energy spread is due principally to two effects: (1) the finite size of the ionization region introduces an energy spread because ions are extracted from regions of different potential, and (2) the initial velocity spread of the neutral atoms before ionization (a gas being generally used as the sample).

An improved version of the TOF mass spectrometer (U.S. Pat. No. 2,685,035) was first described by W. C. Wiley and L. H. McLaren in Rev. Sci. Instr., 26, 1150 (1955). This instrument of Wiley, et al., utilizes a two-step acceleration process or a time delay between ionization and application of extraction fields, or a combination of both to achieve time focusing and thereby improve the resolution of the instrument. By adjustment of operating parameters, the instrument can be optimized to partially compensate for effect (1) or effect (2) above, but not both simultaneously.

A different system, described by B. A. Mamyrin, V. I. Karataev, D. V. Shmikk, and V. A. Zagulin, Sov. Phys. JEPT, 37, 45 (1973) utilizes a time delay introduced by the reflection of ions in a potential barrier to compensate for the differing energies of the extracted ions. More recent workers have improved resolution by utilizing the above techniques in combination with procedures of reducing the velocity spread of the neutral atoms before ionization. The utilization of supersonic molecular beam techniques can significantly reduce the velocity spread of the atoms in the direction parallel to the flight path. These variations are described by D. M. Lubman and R. M. Jordon, Rev. Sci. Instr., 56, 375 (1985); R. B. Opral, K. G. Owens and J. B. Reilly, Anal. Chem. 57, 1884 (1985).

All of the above techniques are applicable to samples that are already in the gas phase, but do not address the situation in which the atoms are removed from a solid surface. In many instances the velocity spread of the removed atoms (from a solid) is intrinsic to the removal method and cannot be reduced. Furthermore, the systems for achieving compensation are elaborate and often defeat the general advantages of TOF mass spectrometers.

Accordingly, it is a principal object of the present invention to provide an improved time-of-flight mass spectrometer, and method of its operation, which compensates for the energy spread that causes poor resolution.

It is another object of the present invention to provide a time-of-flight mass spectrometer where the material is first removed from a surface and wherein energy spread is compensated for.

It is a further object of the present invention to provide a mass spectrometry method using a time-of-flight mass spectrometer wherein atoms or molecules are removed from a surface at a well defined time, and ionized at a well defined time after a selected time delay.

These and other objects of the present invention will become apparent upon a consideration of the following drawings and a complete description thereof.

SUMMARY OF THE INVENTION

In accordance with the present invention, a time-of-flight mass spectrometer, and method of operation, is provided wherein atoms or molecules for analysis are removed from a surface at a well defined time, and the atoms so removed are ionized at a well defined time after a selected time delay. The resultant ions move through a uniform electrical field to achieve a velocity which depends on their mass and then pass through a field-free region prior to entering an acceleration region to strike a detector whereupon an ion arrival time spectrum provides information as to the mass content of the sample. Special cases provide for increased sensitivity over that of conventional TOF mass spectrometers, and for atom enrichment.

DESCRIPTION OF THE INVENTION

In general, this invention takes advantage of two well timed events, the nearly instantaneous release of atoms or molecules from a surface and the nearly instantaneous ionization of the released atoms at a well determined later time. These events, which when combined with appropriately chosen accelerating potentials and drift distances, will cancel the affects of the initial velocity distribution of the released material and the energy spread due to extraction of ions from a finite region in space.

Figure 1:
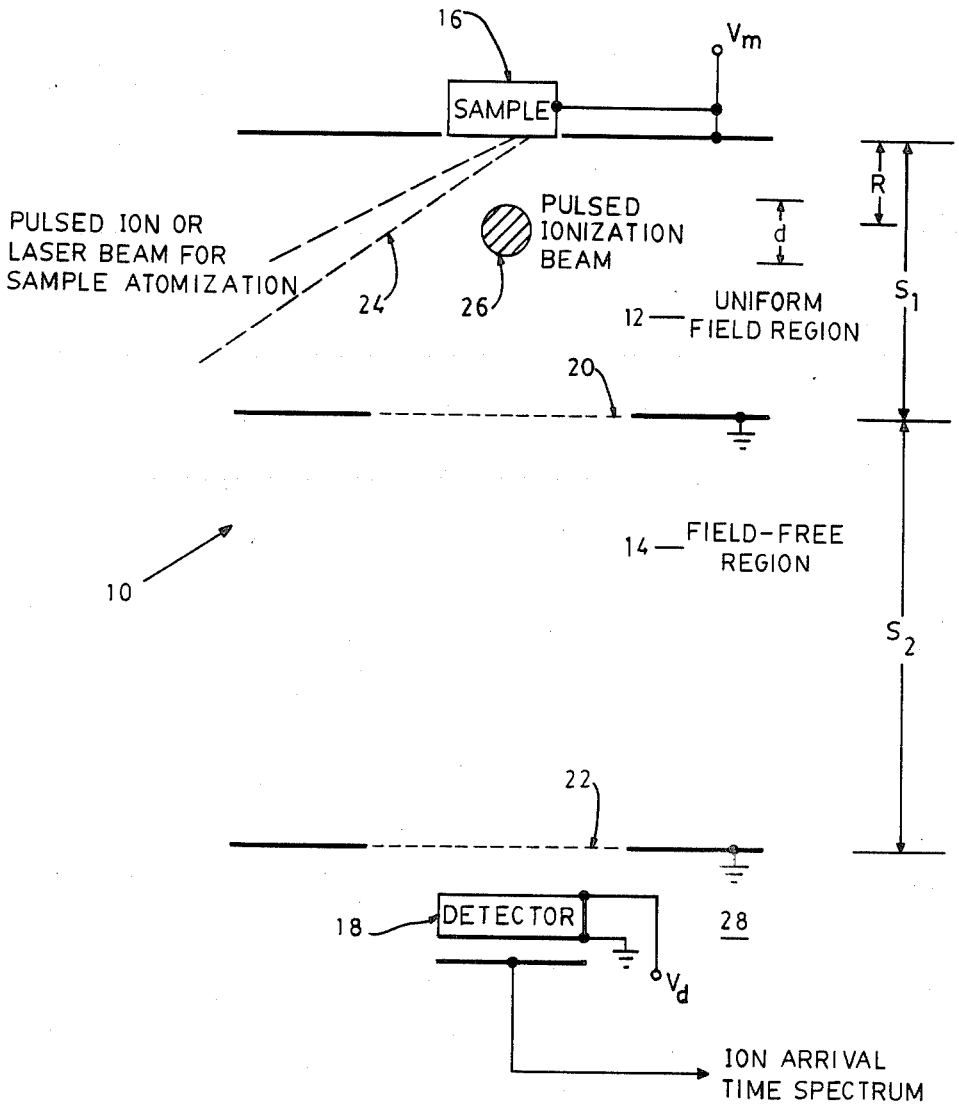
FIG. 1 is a block diagram/schematic drawing illustrating the most general form of the present invention.

The present time-of-flight mass spectrometer 10 can be described with the aid of FIG. 1. The instrument is divided into two regions, one region 12 of length $S_1$ in which a uniform electric field has been established, and a second region 14 of length $S_2$ that is field-free. A sample 16 to be analyzed is at one end of the uniform field region 12 while an ion detector 18 is outside of the field free region 14 on the opposite end. To maintain uniform fields and prevent leakage of electric fields from one region to the next, the regions are separated as by conducting grids 20, 22. Means are provided to release atoms or molecules nearly instantaneously from the sample. This release can be effected by a pulsed ion or laser beam, as indicated at 24, from a source (not shown). Furthermore, means (not shown) are provided to subsequently ionize the expanding cloud nearly instantaneously over a region of diameter, d, and a distance, R, from the sample. Although not shown, the apparatus depicted in this and other of the figures would be encased in a vacuum chamber.

Figure 2:
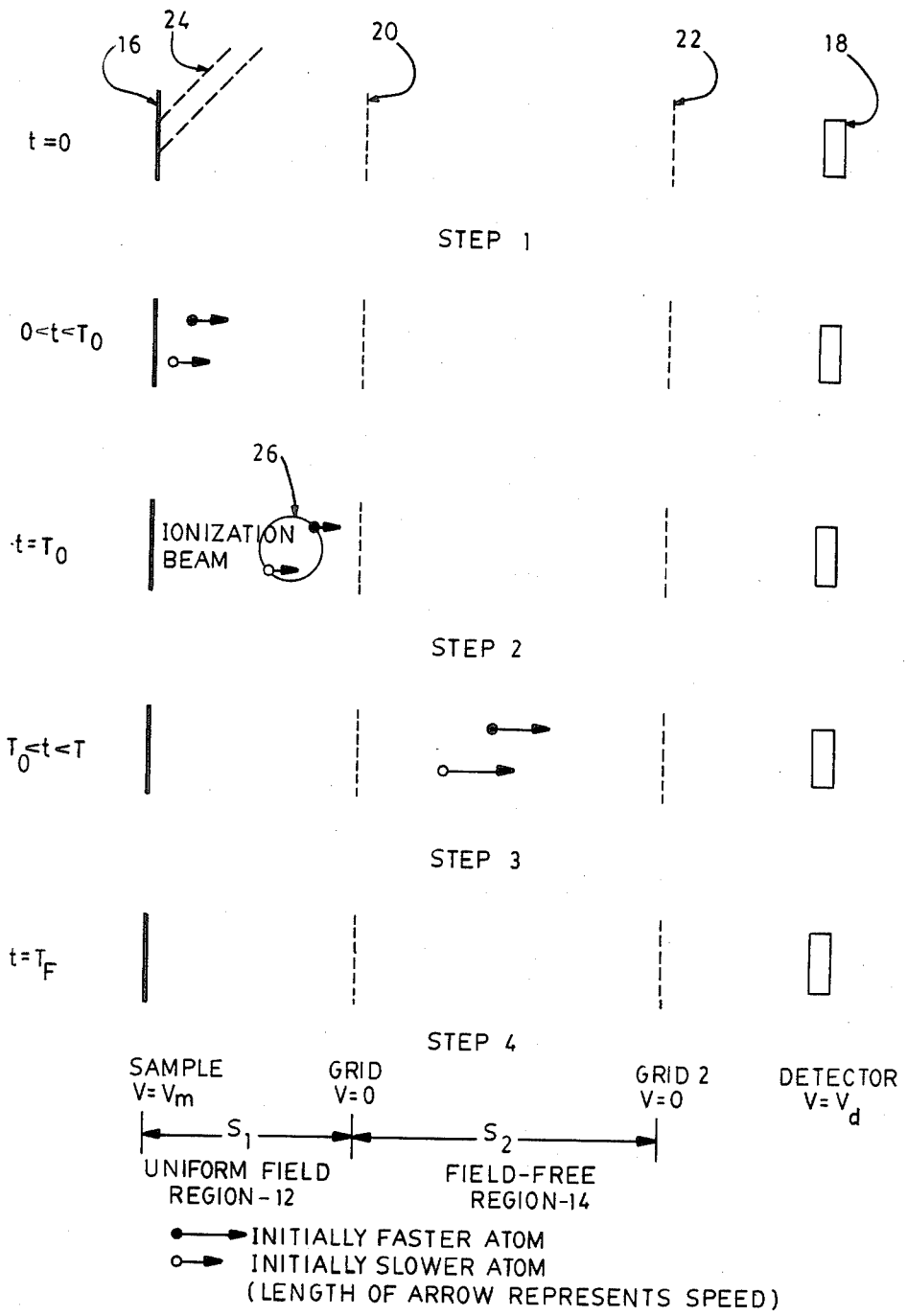
FIG. 2 is a block diagram/schematic drawing illustrating a timing sequence for operation of the present invention.

Referring now to FIG. 2, the processing of a single burst of atoms or molecules has four distinct steps. In the first step, at time $t=0$, a short pulse of mostly neutral atoms and molecules are released from a sample in a very short period of time $T_r$. As stated above, the atoms can be released by either a pulsed ion beam (sputtering), a high energy laser pulse which vaporizes the surface and near surface material, or a moderate energy laser pulse which heats a cryogenic surface sufficiently to release previously frozen gas atoms (special case). The released atoms have a distribution of speeds and begin to spread out (at time $t<T_o$) in front of the plane surface from which they were released.

In the second step, at a time $t=T_o$ ($T_o>>T_r$), a pulsed means of ionization is used to produce ions in a very short period of time $T_i$, with $T_i<<T_o$. The pulsed means of ionization can beeither a pulsed electron beam, a high intensity laser beam that ionizes substantially all elements in the ionization volume, or a series of tuned laser pulses that resonantly ionize only the atoms of a selected element. Sources for these ionizing pulses are well known to persons skilled in the art. The ionization is carried out over a region 26 of a diameter, d, at a distance, R, from the surface of the sample 16 so as to intercept a large fraction of the released atoms or molecules.

The region in front of the sample has a constant electric field 12 directed perpendicular to the plane of the sample source so that the ions produced by the pulsed means are accelerated, in step 3, down the axis of the flight tube. This field is created by a voltage $V_m$ applied to the sample 16, with grid 20 at ground potential. The uniform electric field extends a distance $S_1$ before being reduced to zero in a very short distance by the fine, but highly transparent grid 20. Once the ions reach the grid they pass through and enter a field-free flight region 14 of length $S_2$.

After a time $T_F$, the ions (in step 4) reach the end of the field-free region 14 where a second grid 22 separates the field-free region from a region 20 of high electric field. The ions passing through grid 22 are accelerated to a high kinetic energy in a small distance before striking an ion detector 18 whose response gives a recording of the time of arrival spectrum. The field in this region is created by a voltage $V_d$ applied to the detector 18, with grid 22 at ground potential.

Mass separation is achieved in this TOF by the fact that in the same electric field, light particles are accelerated to higher velocities than heavier particles, and will therefore reach the detector earlier. This is illustrated in the different parts of FIG. 2 for the four steps. It should be noted, however, that because all atoms or molecules leave the surface of sample 16 at the same time, the particles that have only traveled a distance $R-d/2$ when the ionizing pulse occurs (side nearest to the sample) will have a lower initial velocity than the particles that have traveled a distance $R+d/2$. Then the particles that are ionized at $R-d/2$ are accelerated over a greater potential drop, and hence gain more energy, than the ions formed at $R+d/2$.

Therefore, given the dimensions $S_1$ and $S_2$ of the two regions and the mass of the desired particles, with the appropriate choice of electric fields, ionizing region size and position, and time delay, it is possible to make all of the ions of a given mass arrive at the detector simultaneously.

The following describes how the electric field can be chosen to reduce the spread in time of arrival to the point where it is limited primarily by the length of times required for the release of the atoms from the sample and the time of ionization; which can all be very small compared with the flight time. There are several ways of achieving this optimized operation of the TOF mass spectrometer. Three possible configurations are described below.

The most general case has been described by N. Thonnard, M. G. Payne, M. C. Wright and H. W. Schmitt, in Inst. Phys. Conf. Ser. No. 71, 227 (1984), as distributed in late December 1984 or January 1985. This article is incorporated herein by reference. For this case, taking $S_2>>S_1$ and $R\geqq 1.5$ d, the optimal accelerating voltage $V_m$, which makes the spread in arrival time a minimum for a selected mass m, is:

$$V_m=A_1[A_2+(A_3)^{\frac{1}{2}}]_2$$

where $A_1$, $A_2$, and $A_3$ are $$A_1=(2m/q)S_1(S_1-R)T_o^2$$

$$A_2=(S_1-R)/(S_2-2S_1+2R),$$

and $$A_3=S_2+(R/2)/(S_1-R).$$

The distances $S_1$, $S_2$, and R are in cm and defined in FIG. 1; $T_o$ is the time delay in microseconds between the release and ionization of the atoms or molecules; q is the charge of the ions; and m is the mass of the selected ion in amu.

A very useful configuration occurs if the lengths of the uniform field 12 and field-free region 14 are restricted to a particular length. By chosing $S_2=6S_1$, it can be shown that the spread in arrival times for ions at the detector, due to the initial energy spread of the released atoms or molecules, will be zero both in first and second order. The first non-vanishing contribution to the arrival time spread is proportional to $(R/S_1)^3$. This is valid not only for ionization occurring in a restricted volume of diameter, d, at a distance, R, from the target (FIG. 1), but for ionization along the entire space between the target and R.

This, of course, accepts a very large fraction of the released material with a large initial energy spread. In fact, even with R as large as 0.2 $S_1$, the spread in time-of-flight for the selected mass will still be several hundred times smaller than the mean flight time. The optimum electric field value will be generated if the potential is:

$$V_m=\tfrac{1}{2}m/q(S_1/T_o)^2$$

Note that the delay time $T_o$ can be chosen to intercept the maximum number of particles that have been released from the surface. A good choice for the delay time is:

$$T_o = R/(2E_p/m)^{\frac{1}{2}}$$

where $E_p$ is the mean energy of the released particles. If $E_p$ is independent of the particle mass (a condition approximately true for ion sputtering), then the optimum voltage $V_m$ is also independent of the particle mass if the delay time $T_o$ is chosen as indicated above. Even though this optimization is strictly correct for only a particular amu, it can be shown that for $m > 20$ the time-of-flight peaks will still be very narrow for up to five mass units on either side of the optimized mass.

This configuration, in which $S_2 = 6S_1$, is idealy suited for the analysis of solid surfaces utilizing a pulsed ion beam to sputter some material at a well defined time from the sample surface. The pulsed ionization can be produced by several means, including pulsed electron beams, high intensity laser beams causing multi-photon non-resonant ionization, or lasers tuned to specific states of the atoms to be detected (See U.S. Pat. No. 4,442,354, having a common assignee with the present invention) to give the ultimate in selectivitiy and sensitivity. (This patent is incorporated herein by reference.) Sputtering causes the atoms and molecules to leave the surface with considerably more energy (on the order of 1 to 2 eV) than thermal vaporization; therefore, the large energy spread acceptance of this time-of-flight configuration allows a large fraction of the sputtered material to be utilized while still maintaining good resolution.

A third useful configuration for the double pulsed time-of-flight mass spectrometer occurs if the length of the field-free region 14 chosen is $S_2 = 2(S_1 - R)$. Under these conditions, it can be shown that the dispersion in arrival time of the ions at the detector, as a function of starting point, is zero to first order. These conditions are valid for a small region around R, therefore the condition $d << R$ needs to be satisfied. The spread in arrival time as a fraction of the time-of-flight, $T_F$, is:

$$\Delta t/T_f 67\ d/4R(E_p/V_m)^{\frac{1}{2}}$$

It should be noted that these conditions are valid for any value of $V_m$, so $V_m$ can be chosen to best match the conditions of the analysis. Equations for the determination of the optimum parameters are given in the aforementioned reference by Thonnard, et al. As the spread in arrival times is proportional to the square root of the ratio of the average particle starting energy to final energy, this configuration is more applicable to situations in which the initial particle energy is low.

The configuration in which $S_2 = 2(S_1 - R)$ is idealy suited for the isotopically selective detection of noble gas atoms. In a previous patent, (U. S. Pat. No. 4,426,576, having a common assignee with the present invention) a method for counting very rare isotopes of noble gas atoms in the presence of much more abundant adjacent isotopes was described. In this patent, which is incorporated herein by reference, an "atom buncher" is described which collects and subsequently releases atoms in a burst just before an ionizing laser is fired, thereby concentrating the atoms to increase the detected signal. The "atom buncher" collects the noble gas atoms by freezing them on a cold surface and releases them from the surface nearly instantaneously with a pulsed laser. As the noble gas atoms leaving the surface have very low energy, i.e. about 0.01 eV, and as the release and ionization is nearly instantaneous (when compared to the delay time $T_o$), the resolution can be very good in this configuration of the present invention even with an accelerating potential as low as 100 V.

Figure 3:
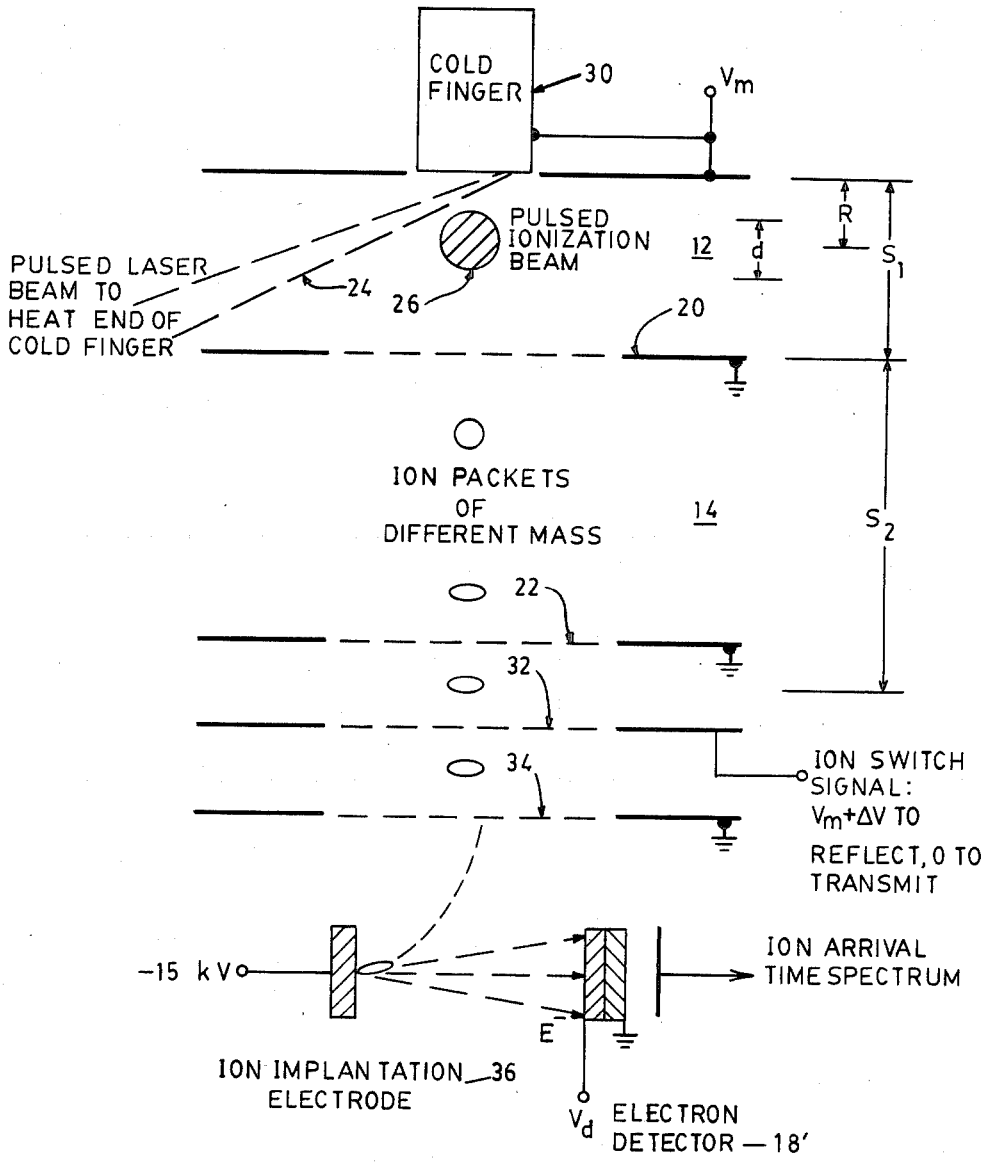
FIG. 3 is a block diagram/schematic drawing illustrating another special case of the present invention as used for atom enrichment.

As a result of the features of this configuration, a new method for enriching noble gases can be described which combines features of this invention with teachings in the above-referenced U.S. Pat. No. 4,426,576. Referring to FIG. 3, the time-of-flight mass spectrometer is essentially the same as in FIG. 1 except that the sample has been replaced with a cold finger 30 which can be heated with a pulsed laser beam 24'. At the detector end, two additional grids 32, 34 are placed to act as an "ion switch". By applying a potential on the center grid 32 that is higher than the ion energy, it is possible to turn around the desired ions when they are in the gap between the grids 22, 32 without affecting the trajectories of the ions in other regions. Therefore, by pulsing this grid 32 at an appropriate time, it is possible to turn around, or pass through, particular ions of isotopes of the selected noble gas atoms. If the mass spectrometer is operated in a static vacuum chamber, it is possible to remove interfering isotopes from a noble gas sample while retaining the desired isotope by reflecting the desired isotope ions to return to the cold finger 30 while passing the undesired isotope ions through to an implantation electrode 36 at a high electric potential, e.g., −15 kV. After a desired number of enrichment stages, the desired ions are permitted to strike the detector 18'.

This type of enrichment in the desired isotope is only possible because the new time-of-flight mass spectrometer described herein can be operated at very low accelerating potentials in the uniform field 12. Since the energy spread losses are eliminated as discussed above, the low potentials allow long flight times in reasonably-sized instruments with sufficient spatial and temporal separation to effect the ion switching. In addition, it is known that noble gas atoms are trapped by implantion into surfaces if the ion energy is much greater than a few hundred volts. Therefore, without the low energies possible with this new spectrometer, the enrichment method described would suffer large losses of the desired isotope on surfaces of the device.

From the foregoing, it will be recognized by those skilled in the art that an improved method of operation of a time-of-flight mass spectrometer has been fully described. This method, in a simple manner, eliminates the detrimental energy spread that otherwise exists with its accompanying reduction in resolution or mass discrimination. Although limited embodiments have been described, these are not provided to limit the scope of the invention. Accordingly, the scope of the invention is only to be limited by the claims appended hereto and their equivalents. It will be recognized by persons skilled in the art that the parameters set forth in the claims can be determined using the equations set forth above.

We claim:

1. A method for improving mass discrimination during an analysis of atoms or molecules in a time-of-flight mass spectrometer, such method conducted within an evacuated chamber, which comprises:

rapidly removing, at a first well defined time, such atoms or molecules to be analyzed from a surface containing such atoms or molecules in a region of a uniform electric field of a selected strength;

rapidly ionizing, at a second well defined time after a selected time delay, $T_o$, the removed atoms or molecules with an ionizing beam in a defined ionization region spaced a first defined distance, R, from said surface;

accelerating ions, produced by said ionizing beam, in said uniform field region of a second defined distance, $S_1$;

passing said ions into a field-free region for drifting therein for a third defined distance, $S_2$;

passing said ions into a relatively short, high-energy acceleration region to strike an ion detector to produce a signal corresponding to the arrival of said ions;

measuring said signal as a function of arrival time to obtain such analysis;

wherein said time delay, said uniform field and said defined distances are chosen to minimize spread in arrival time at said detector of a specified mass within such atoms or molecules.

2. The method of claim 1 wherein:

a. said ionization region has an average diameter, d, and said first defined distance, R, is at least $1\frac{1}{2}$ times said diameter; and b. said strength of said uniform electric field for a given value of R, $S_1$, $S_1$, and $T_o$, is chosen to minimize the arrival time spread of ions of a particular mass at said detector so as to compensate for velocity spread of such atoms or molecules leaving said surface and ionized in said defined region.

3. The method of claim 1 wherein:

a. said ionization region covers the entire said first defined distance, R, and is equal to or less that 1/5 of said second defined distance, $S_1$, of said uniform field region;

b. said third defined distance, $S_2$, of said field-free region is 6 times said second defined distance, $S_1$, of said uniform field region; and c. said strength of said uniform electric field for a given value of R, $S_1$, $S_2$, and $T_o$, is chosen to minimize the arrival time spread of ions of a particular mass at said detector so as to compensate for velocity spread of such atoms or molecules leaving said surface and ionized in said defined region.

4. The method of claim 1 wherein:

a. said ionization region has an average diameter, d, that is small compared to said first defined distance, R;

b. said third defined distance, $S_2$, of said field-free region is two times the difference between said second defined distance, $S_1$, and said first defined distance, R;

c. energy given to said released atoms or molecules is much smaller than energy given to said ions in said high energy acceleration region;

d. the arrival time spread at said detector will be a minimum and independent of said field strength of said uniform electric field.

5. The method of claim 2 wherein said surface is a solid and wherein said removing of such atoms or molecules from said surface is accomplished by sputtering from said surface using a pulsed energetic ion beam.

6. The method of claim 3 wherein said surface is a solid and wherein said removing of such atoms or molecules from said surface is accomplished by sputtering from said surface using a pulsed energetic ion beam.

7. The method of claim 4 wherein said surface is a solid and wherein said removing of such atoms or molecules from said surface is accomplished by sputtering from said surface using a pulsed energetic ion beam.

8. The method of claim 2 wherein said surface is a solid and wherein said removing of such atoms or molecules from said surface is accomplished by atomization from said surface with an energetic pulsed laser beam.

9. The method of claim 3 wherein said surface is a solid and wherein said removing of such atoms or molecules from said surface is accomplished by atomization from said surface with an energetic pulsed laser beam.

10. The method of claim 4 wherein said surface is a solid and wherein said removing of such atoms or molecules from said surface is accomplished by atomization from said surface with an energetic pulsed laser beam.

11. The method of claim 2 wherein such atoms or molecules are gases frozen upon said surface, and such atoms or molecules are removed from said surface by rapidly heating said surface with a pulsed laser beam.

12. The method of claim 3 wherein such atoms or molecules are gases frozen upon said surface, and such atoms or molecules are removed from said surface by rapidly heating said surface with a pulsed laser beam.

13. The method of claim 4 wherein such atoms or molecules are gases frozen upon said surface, and such atoms or molecules are removed from said surface by rapidly heating said surface with a pulsed laser beam.

14. The method of claim 1 wherein said ionization is achieved using a pulsed electron beam.

15. The method of claim 1 wherein said ionization is achieved using a multiphoton non-resonant process with a high intensity pulsed laser beam.

16. The method of claim 1 wherein said ionization is achieved for specific atoms or molecules by using resonance ionization with tuned pulsed dye laser beams to achieve enhanced sensitivity and selectivity of said specific atoms or molecules.

17. The method of claim 1 wherein said time delay, $T_o$, is chosen to intercept the maximum number of released atoms or molecules by said ionizing beam.

18. The method of claim 17 further comprising: providing a switchable electric field between said field-free region and said high energy acceleration region, said switchable electric field directing selected ions of said specific atoms or molecules in a selected time interval to said surface and passing remaining ions to an implantation electrode for removing said remaining ions wherein said selected ions of said specific atoms or molecules are enriched by such time-of-flight mass spectrometer.

19. A method for improving mass discrimination during an analysis of atoms or molecules in a time-of-flight mass spectrometer, such method conducted within an evacuated chamber, which comprises:

rapidly removing, at a first well defined time, such atoms or molecules from a surface containing such atoms or molecules in a region of a uniform electric field of a selected strength;

rapidly ionizing, at a second well defined time after a selected time delay, $T_o$, the removed atoms or molecules within said uniform electric field with an ionizing beam in a defined region having an average diameter, d, said defined region separated from said surface a first defined distance, R, where R is at least $1\frac{1}{2}$ times said diameter, d;

accelerating ions produced by said ionizing in said uniform field region over a second defined distance, $S_1$;

passing said ions from said uniform electric field into a field-free region for drifting therein a third defined distance, $S_2$;

passing said ions from said field-free region into a relatively short, high-energy acceleration region to strike an ion detector to produce a signal corresponding to the arrival of said ions;

measuring said signal as a function of arrival time to obtain such analysis; and wherein said strength of said uniform electric field, for a given value of R, $S_1$, $S_2$, and $T_o$, is chosen to minimize the arrival time spread of ions of a particular mass at said detector.

20. A method for improving mass discrimination during an analysis of atoms or molecules in a time-of-flight mass spectrometer, such method conducted within an evacuated chamber, which comprises:

rapidly removing, at a first well defined time, such atoms or molecules to be analyzed from a surface containing such atoms or molecules in a region of a uniform electric field of a selected strength;

rapidily ionizing, at a second well defined time after a selected time delay, $T_o$, the removed atoms or molecules within said uniform electric field with an ionizing beam in a defined region, said defined region being the entire distance from said surface, a first defined distance, R, where R is equal to or less than 1/5 of a second defined distance, $S_1$;

accelerating ions produced by said ionizing in said uniform field region over said second defined distance, $S_1$;

passing said ions from said uniform electric field into a field-free region for drifting therein for a third defined distance, $S_2$, said distance $S_2$ being six times said second defined distance $S_1$;

further accelerating said ions in a short accelerating region, having an field strength much greater than said field strength of said uniform electric field adjacent said surface, to strike an ion detector to produce a signal corresponding to the arrival of said ions; and measuring said signal as a function of arrival time to obtain such analysis.

21. A method for improving mass discrimination during an analysis of atoms or molecules in a time-of-flight mass spectrometer, such method conducted within an evacuated chamber, which comprises:

rapidly removing, at a first well defined time, such atoms or molecules to be analyzed from a surface containing such atoms or molecules in a region of a uniform electric field of a selected strength;

rapidily ionizing, at a second well defined time after a selected time delay, $T_o$, the removed atoms or molecules within said uniform electric field with an ionizing beam in a defined region having an average diameter, d, said defined region being spaced from said surface a first defined distance, R, where d is small compared to R;

accelerating ions produced by said ionizing beam in said uniform field region over a second defined distance, $S_1$;

passing said ions from said uniform electric field into a field-free region for drifting therein for a third defined distance, $S_2$, said distance $S_2$ being two times the difference between distance $S_1$ and R;

passing said ions into a relatively short accelerating region, having an field strength much greater than said field strength of said uniform electric field adjacent said surface, to strike an ion detector to produce a signal corresponding to the arrival of said ions; and measuring said signal as a function of arrival time to obtain such analysis.

22. A method for improving mass discrimination and enriching a specific mass during an analysis of atoms or molecules in a time-of-flight mass spectrometer, such method conducted within an evacuated chamber, which comprises the steps of:

freezing such atoms or molecules upon a surface;

rapidly removing, at a first well defined time, such atoms or molecules from said surface in a region of a uniform electric field of a selected strength;

rapidly ionizing, at a second well defined time and after a selected time delay, $T_o$, such atoms or molecules with an ionizing beam in a defined region spaced a first defined distance, R, from said surface;

accelerating ions produced by said ionizing in said uniform field of a second defined distance, $S_1$;

passing said ions into a field-free region for drifting therein for a third defined distance, $S_2$;

passing said ions through a switchable electric field into a high-energy acceleration region containing an electron detector and an ion implantation electrode, said detector producing a signal corresponding to the arrival of ions at the implantation electrode due to electrons ejected from said electrode;

switching said electric field in proper timing to direct selected ions of such specific mass to said surface and remaining ions to said implantation electrode;

repeating said steps from said removing step to said switching until a desired enrichment level of such mass is achieved;

then permitting said ions of such specific mass to strike said detector; and measuring said signal from said detector as a measure of such enrichment and analysis of such specific mass.

* * * * *